US007585607B2

(12) United States Patent
Miyakawa et al.

(10) Patent No.: US 7,585,607 B2
(45) Date of Patent: Sep. 8, 2009

(54) METHOD OF MANUFACTURING TONER, THE TONER PRODUCED THEREBY, DEVELOPER CONTAINING THE TONER AND AN IMAGE FORMING APPARATUS USING THE TONER

(75) Inventors: Masashi Miyakawa, Numazu (JP); Noboru Kuroda, Izunokuni (JP); Kazuyuki Matsui, Fuji (JP); Hiroshi Takahashi, Numazu (JP); Takahiro Kadota, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 349 days.

(21) Appl. No.: 11/375,017

(22) Filed: Mar. 15, 2006

(65) Prior Publication Data

US 2006/0216629 A1 Sep. 28, 2006

(30) Foreign Application Priority Data

Mar. 15, 2005 (JP) ..... 2005-073556
Jan. 25, 2006 (JP) ..... 2006-016944

(51) Int. Cl.
*G03G 9/08* (2006.01)

(52) U.S. Cl. ..... 430/137.14; 523/335

(58) Field of Classification Search ..... 430/137.14; 523/335

See application file for complete search history.

(56) References Cited

U.S. PATENT DOCUMENTS 5,364,729 A * 11/1994 Kmiecik-Lawrynowicz et al. ..... 430/137.14
2002/0196702 A1* 12/2002 Shechter ..... 366/167.1
2004/0234882 A1 11/2004 Matsui et al.

FOREIGN PATENT DOCUMENTS

| | | | |
|---|---|---|---|
| EP | 0 631 195 | A1 | 12/1994 |
| EP | 1 376 248 | A1 | 1/2004 |
| EP | 1 494 081 | A2 | 1/2005 |
| JP | 10-195205 | | 7/1998 |

OTHER PUBLICATIONS

Diamond, Arthur S & David Weiss (eds.) Handbook of Imaging Materials, 2nd ed.. New York: Marcel-Dekker, Inc (Nov. 2001) pp. 145-164.*
U.S. Appl. No. 12/019,112, filed Jan. 24, 2008, Usami, et al.
U.S. Appl. No. 12/043,627, filed Mar. 6, 2008, Higuchi et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

A method of manufacturing a toner including dissolving or dispersing a toner component containing a colorant and a resin in an organic solvent to obtain a liquid solution or dispersion, continuously emulsifying and dispersing the liquid solution or dispersion in an aqueous medium containing a particulate dispersant to obtain emulsified primary particles, controlling cohesion and agglomeration of the emulsified primary particles and removing the organic solvent, such that the ratio (T1/T2) of the arithmetic mean accumulation time (T1) of the emulsified primary particles obtained in the controlling step to the arithmetic mean accumulation time (T2) of the emulsified primary particles obtained in the continuously emulsifying and dispersing step is from 1 to 5.

15 Claims, 1 Drawing Sheet

METHOD OF MANUFACTURING TONER, THE TONER PRODUCED THEREBY, DEVELOPER CONTAINING THE TONER AND AN IMAGE FORMING APPARATUS USING THE TONER

BACKGROUND OF THE INVENTION

1. Field of the Invention

The present invention relates to a method of manufacturing a toner, the toner produced using the method, developer containing the toner and an image forming apparatus using the toner.

2. Discussion of the Background

In an image forming apparatus for use in Electrophotography and similar areas, a toner is used as a developer (either one-component or two-component developer) to develop an electrostatic image. Typically, such a toner is manufactured by melting, mixing and dispersing a release agent, a colorant, and a charge controlling agent in a thermoplastic resin as the main component followed by uniforming, pulverizing and classifying the resultant. A toner manufactured by such a pulverization method has excellent characteristics in some degree. Recently, a toner having a small particle diameter and a sharp particle size distribution has been demanded to obtain images with high definition, good sharpness, and high gradation. To satisfy these demands using a pulverized toner, a classification process is additionally needed in which the pulverized toner is classified to achieve a sharp particle size distribution. To obtain a toner beyond the ability of a typically pulverized toner for an image having a high definition, fine toner particles having a particle diameter not greater than 5 μm and coarse particles having a particle diameter not less than 20 μm are removed. As a result, it is inevitable that the toner yield is extremely low.

In recent years, to overcome these problems involved in the pulverization method, a toner manufacturing method such as a suspension polymerization method has been proposed. A typical suspension polymerization method is as follows: melt, mix or disperse a polymeric monomer, a colorant, a release agent, a polymerization initiator and a dispersant to obtain an oil phase; put the oil phase in an aqueous phase (water or a mixture of water and a dispersion stabilizer or a thickening agent for use in viscosity adjustment); and impart a high shearing force to the resultant to prepare an O/W emulsion (hereinafter referred to as emulsified dispersion liquid) for polymerization to granulate colored polymeric particles (toner). Different from the pulverization method, this suspension polymerization method disperses release agent, colorant, etc., in a solvent having a low viscosity. Therefore, it is possible to obtain a toner having a more uniform composition and a sphere form. In addition, a polymerized toner having a sharp particle size distribution can be obtained at a high yield ratio by the suspension polymerization method.

As a method of manufacturing a toner based on these polymerization methods, unexamined published Japanese patent application No. H10-195205 describes a manufacturing method in which a toner component is turned into fine droplets or particulates by a high speed shearing device and these fine droplets and particulates are polymerized to obtain a resin particle.

However, the method in which fine droplets and particulates (hereinafter referred to as emulsified primary particles) are continuously manufactured by a high speed shearing device, introduced into a tank or a facility in the next process and cohered or agglomerated by stirring to obtain an objective particle has a drawback. That is, behaviors of fluid and particles of emulsified primary particles in the pipes to the tank have a great impact on the particle diameter of the finally obtained particle. This leads to production of coarse particles, deterioration of particle size distribution and non-uniformity of the toner composition.

Accordingly, a need exists for a method of manufacturing a toner by which the production of coarse particles and deterioration of particle size distribution can be restrained and the composition of the toner obtained can be made more uniform.

SUMMARY OF THE INVENTION

Accordingly, an object of the present application is to provide a method of manufacturing a toner by which the production of coarse particles and deterioration of particle size distribution can be restrained and the toner composition can be made more uniform.

Another object of the present application is to provide a toner manufactured by the method and an image forming apparatus producing images with the toner.

These objects and other objects of the present invention, as hereinafter described, will become more readily apparent and can be attained, either individually or in combination thereof, by a method of manufacturing a toner including dissolving or dispersing a toner component containing a colorant and a resin in an organic solvent to obtain a liquid solution or dispersion, continuously emulsifying and dispersing the liquid solution or dispersion in an aqueous medium containing a particulate dispersant to obtain emulsified primary particles, controlling cohesion and agglomeration of the emulsified primary particles and removing the organic solvent. In addition, the ratio (T1/T2) of the arithmetic mean accumulation time (T1) of the emulsified primary particles obtained in the controlling step to the arithmetic mean accumulation time (T2) of the emulsified primary particles obtained in the continuously emulsifying and dispersing step is from 1 to 5.

BRIEF DESCRIPTION OF THE DRAWINGS

Various other objects, features and attendant advantages of the present invention will be more fully appreciated as the same becomes better understood from the detailed description when considered in connection with the accompanying drawings wherein.

DETAILED DESCRIPTION OF THE INVENTION

Figure 1:
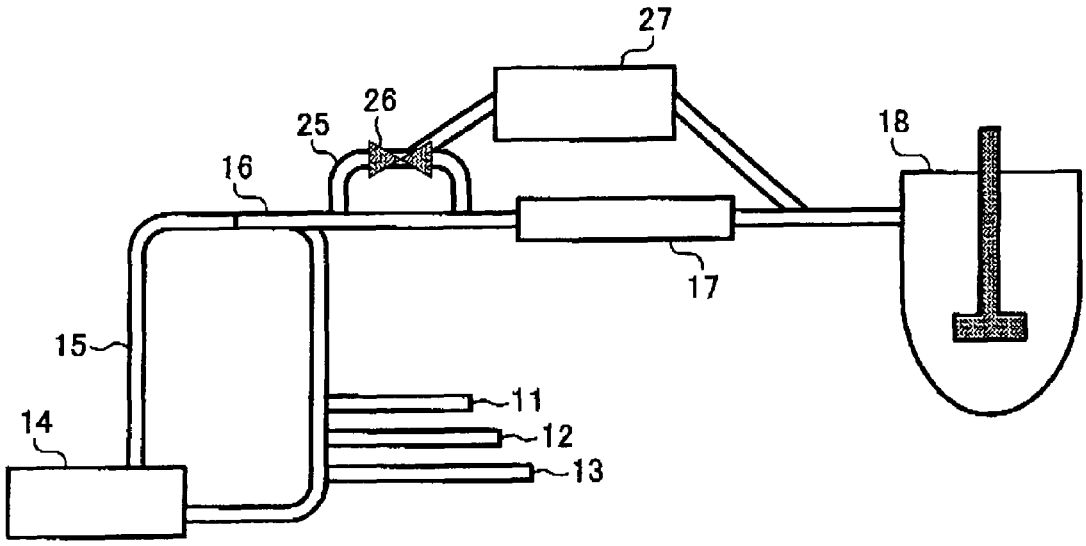
FIG. 1 is a diagram illustrating an example of the manufacturing method of the toner of the present application.

The present invention will be described below in detail with reference to several embodiments and accompanying drawings.

An initial embodiment of the present invention relates to a method of manufacturing a toner. The method of manufacturing a toner comprises: dissolving or dispersing a toner component containing a colorant and a resin in an organic solvent; continuously emulsifying and dispersing the liquid solution or dispersion that results in an aqueous medium to obtain an emulsified primary particle; controlling the agglomeration and cohesion of the emulsified primary particle; and removing the organic solvent. The arithmetic mean accumulation time of the toner component in the controlling step is 1 to 5 times as large as that in the continuously emulsifying and dispersing step.

It is preferred that, in the method of manufacturing a toner mentioned above, the controlling step is performed by a static mixer.

It is still further preferred that, in the method of manufacturing a toner mentioned above, the controlling step is performed to produce a Karman vortex street using a vortex shedder.

It is still further preferred that, in the method of manufacturing a toner mentioned above, the controlling step is performed by a stirring bar driven by an external magnetic force.

It is still further preferred that, in the method of manufacturing a toner mentioned above, the controlling step is performed by adding a liquid, which preferably contains a surface active agent.

It is still further preferred that, in the method of manufacturing a toner mentioned above, the controlling step is performed using a plurality of pipes having different lengths.

It is still further preferred that, in the method of manufacturing a toner mentioned above, the controlling is performed using a plurality of pipes having different diameters.

It is still further preferred that, in the method of manufacturing a toner mentioned above, the controlling step is performed using a particle size distribution measuring system.

It is still further preferred that, in the method of manufacturing a toner mentioned above, the particle size distribution measuring system includes a main pipe and a bypass pipe by which one can sample a liquid flowing in the main pipe.

It is still further preferred that, in the method of manufacturing a toner mentioned above, the particle size distribution measuring system further includes a mechanism of controlling an accumulation time of the liquid flowing in the bypass pipe.

It is still further preferred that, in the method of manufacturing a toner mentioned above, the particle size distribution measuring system further includes a valve by which sampling a liquid from the bypass pipe can be intermittently performed.

It is still further preferred that, in the method of manufacturing a toner mentioned above, the particle size distribution measuring system further includes a device configured to dilute the sample liquid obtained using the valve and a mechanism configured to set a dilution ratio of the sample liquid.

It is still further preferred that, in the method of manufacturing a toner mentioned above, the dilution ratio is from 300 to 2,000.

It is still further preferred that, in the method of manufacturing a toner mentioned above, the particle size distribution measuring system includes a device configured to return the liquid to the main pipe, when the particle size distribution measurement is completed.

As another aspect of the present application, a toner containing a resin and a colorant is provided. The toner is manufactured by the present invention method described in the embodiment above. In the toner of the present invention, the remaining amount of the organic solvent is not greater than 500 ppm.

It is preferred that the toner mentioned above further has a volume average particle diameter (DV) of from 3 to 10 μm and an average circularity of 0.92 to 0.96 when measured by a flow type particle image analyzer.

It is still further preferred that the toner has a ratio (Dv/Dn) of the volume average particle diameter (DV) thereof to the number average particle diameter (Dn) thereof of from 1.05 to 1.25.

As another aspect of the present invention, a developer is provided which contains the toner mentioned above and a carrier.

As another aspect of the present invention, an image forming apparatus is provided which comprises an image bearing member configured to bear a latent image, a developing device configured to develop the latent image borne on the image bearing member with the toner of the present invention, a transfer device configured to transfer the developed toner image on the image bearing member to a recording medium and a cleaning device including a cleaning blade configured to clean the surface of the image bearing member.

FIG. 1 is a diagram illustrating a method of manufacturing a toner of the present application. A toner component (e.g., toner component containing a colorant and a resin, an aqueous medium containing a particulate dispersant) as a toner material is supplied from introduction lines 11 to 13. These supplied components are introduced into a dispersion liquid accumulation portion 15 and circulates in the accumulation portion including an emulsification device 14. In the emulsification device 14, a dissolved dispersion liquid obtained by dissolving or dispersing the toner component in an organic solvent and the aqueous medium containing a particulate dispersant are sheared for emulsification and dispersion. Thus, an emulsified primary particle is obtained. After a desired period of time, the emulsified primary particle is introduced into a cohesion and agglomeration controlling tank 18. Subsequent to a further treatment, a mother toner particle having a desired particle diameter is obtained. Each component that overflows from the dispersion liquid accumulation portion 15 and the emulsification device 14 accumulates in a dispersion liquid overflowing portion 16. Joint pipes connecting the dispersion liquid accumulation portion 15 with the cohesion and agglomeration controlling tank 18 are hereinafter referred to as piping structure.

Controlling Cohesion and Agglomeration

The phenomenon of cohesion and agglomeration of the emulsified primary particles (hereinafter referred to as cohesion and agglomeration or cohesion and agglomeration phenomenon) out of the dispersion liquid accumulation portion 15 is controlled in the piping structure. The cohesion and agglomeration phenomenon of the emulsified primary particles can be controlled by various kinds of devices introduced in the piping structure to obtain a toner having a desired particle diameter, which is described later. Thereby, it is possible to restrain the production of coarse particles and deterioration of the particle size distribution, improve productivity and stabilize the quality of the product. In addition, a controlling device to control the cohesion and agglomeration phenomenon in the piping structure eliminates the need of a typical tank and facility to control the particle size. Therefore, the number of processes is reduced, which leads to improvement of the productivity and the reduction of facility cost.

Controlling Device

There is no specific limit to the controlling device 17 in the piping structure and any device can be used as long as the device can control the cohesion and agglomeration phenomenon among emulsified primary particles to prepare a mother toner particle having a desired particle diameter. Specific examples thereof include a static mixer, a method utilizing production of a Karman vortex street 24 and a rotator driven by an external magnetic field. By using such a controlling device, mother toner particles having a desired particle diameter can be obtained from emulsified primary particles introduced into the piping structure.

Figure 2:
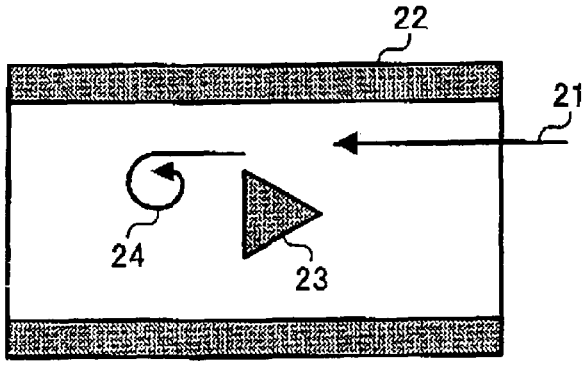
FIG. 2 is a schematic diagram illustrating a method of generating a Karman vortex street.

When the Karman vortex street 24 illustrated in FIG. 2 is utilized, a vortex shedder 23 can be disposed in a desired direction based on the flowing direction of the liquid in a pipe 22. A right angle is preferred. Thereby, downstream the Karman vortex street 24 is produced by the vortex shedder 23 and the cohesion and agglomeration phenomenon among the emulsified primary particles can be controlled. The vortex shedder 23 illustrated in FIG. 2 has a triangle form but is not limited thereto. Various kinds of vortex shedders such as a trapezoid form and a square form can be selected according to the desired Karman vortex street.

In addition, these controlling devices can be multiplied or used in combination to promote the controlling ability. For example, static mixers can be used in two or three steps.

Further, it is possible to control the cohesion and agglomeration phenomenon among the emulsified primary particles by a fluid introduced as a controlling device in the piping structure. Various kinds of liquids can be used. Especially, when the cohesion and agglomeration phenomenon among the emulsified primary particles occurs quickly in relation to the physical structure of the piping structure, a liquid equivalent to the organic solvent described later forming the dispersion liquid of the emulsified primary particles can be introduced. In addition, such a liquid can contain a surface active agent which restrains the cohesion and agglomeration phenomenon among the emulsified primary particles. Any type of surface active agents, i.e., ionic, nonionic or ampholytic surface active agent, can be used. Especially, an anionic surface active agent having one or more fluoroalkyl groups can have an excellent effect even in an extremely small amount.

Further, it is also possible to control the cohesion and agglomeration phenomenon by changing the length and diameter of the piping structure. For example, when the cohesion and agglomeration phenomenon among the emulsified primary particles occurs quickly, the length of the piping structure can be shortened or a piping structure having a large diameter can be used. To the contrary, when the cohesion and agglomeration phenomenon among the emulsified primary particles occurs slowly, the length of the piping structure can be lengthened or a piping structure having a small diameter can be used. Thereby, the accumulation time and the flow speed of each component in the piping structure can be varied. Therefore, it is possible to restrain or promote the size increase of the particles and the production of coarse particles.

Furthermore, an inline particle size distribution measuring device 27 can be used in combination to improve the control accuracy. For example, an inline detector detects the speed difference of the cohesion and agglomeration phenomena among the emulsified primary particles and thereafter the controlling as described above is performed. Consequently, each controlling device can effectively function.

The piping structure illustrated in FIG. 1 is structured using a single piping. Plural piping structures can also be used. In addition, the controlling devices described above can be structured in combination in a single or plural piping structures.

Bypass Piping Route

As an accumulation time controlling device of a bypass piping route 25, it is preferred to provide a sampling valve 26 in the main pipe or the bypass piping route 25. Using the sampling valve 26, a desired sampling amount of the liquid can be intermittently sampled. In addition, changing the full length and the total volume of the bypass piping route 25 is also an effective method of controlling the accumulation time.

In addition, by providing these controlling devices, it is possible to control the time length before a sampling starts and therefore, a sample having a target cohesion degree can be obtained. Also, the measuring accuracy can be improved.

Arithmetic Mean Accumulation Time

In the present application, each toner component is introduced into the emulsification device 14 and the dispersion liquid accumulation portion 15, and then into the cohesion accumulation controlling tank 18 by way of the piping structure. It is found that the relationship between the arithmetic mean accumulation time of each component accumulating in the emulsification device 14 and the dispersion liquid accumulation portion 15 and that in the piping structure is important in terms of the cohesion and agglomeration phenomenon. Especially, the arithmetic mean accumulation time of each component accumulating in the piping structure is preferably 1 to 5 times, and more preferably from 2 to 3 times, as long as that in the emulsification device 14 and the dispersion liquid accumulation portion 15. When the ratio of the arithmetic mean accumulation times is too large, the cohesion and agglomeration phenomenon occurs excessively easily and coarse particles and agglomeration matters tend to be produced in addition to the deterioration of productivity. When the ratio of the arithmetic mean accumulation times is too small, the productivity is improved but the cohesion and agglomeration phenomenon does not sufficiently occur while each component is accumulating in the piping structure. Therefore, the particle size distribution tends to deteriorate.

The arithmetic mean accumulation times of each component in the emulsification device 14 and the dispersion liquid accumulation portion 15 and in the piping structure can be calculated by dividing the sum of the volumes of the emulsification device 14 and the dispersion liquid accumulation portion 15 and the volume of the portion filled with the liquid in the piping structure with the sum of the flowing amount of the introduction lines 11 to 13, respectively.

Particle Size Distribution Measuring System

Specific examples of the inline particle size distribution measuring device 27 include FBRM (manufactured by Mettler Toledo K.K.), AccuSizer (manufactured by Particle Sizing System Co.), and INSITEC L (manufactured by Malvern Instruments Ltd.). For example, FBRM has a simple structure and can measure the particle size distribution without diluting a sample. However, when a sample which tends to be adhesive or agglomerate is measured with FBRM, it is difficult to maintain the measuring accuracy. Therefore, FBRM is not suitable for a manufacturing facility. In addition, INSITEC Land AccuSizer require dilution for measuring. Therefore, such devices have a complicated structure but can operate for a long period of time with a stable measuring accuracy. In addition, as for those devices requiring dilution, the dilution ratio is preferably from 300 to 2,000. When the dilution ratio is too small, attachment tends to occur, which may hinder the measurement. When the dilution ratio is too large, the number of measuring target particles decreases so that the diluting solvent used is required in an excessively great amount. Therefore, the measuring accuracy and the productivity may deteriorate.

Each component forming the toner for use in the present application is described below.

As a resin forming the toner component, a modified polyester reactive with an elongation agent and/or a cross-linking agent can be mentioned. For example, a polyester prepolymer (A) having an isocyanate group can be mentioned. This prepolymer (A) is a material formed by reacting a polyester having an active hydrogen group, which is a polycondensed material of a polyol (1) and a polycarboxylic acid (2), with an isocyanate group (3). Specific examples of groups having an active hydrogen contained in the polyester include alcoholic or phenolic hydroxyl group, amino group, carboxyl group, and mercapto group. Among these, alcoholic hydroxyl group is preferred.

As the cross-linking agent and the elongation agent, amine (B) can be preferably used.

The toner of the present application preferably contains a urea modified polyester (i) obtained through the reaction of a polyester prepolymer (A) having an isocyanate group and an amine (B) as a toner binder.

The modified polyester represents a polyester resin containing a linkage group other than an ester linkage or a polyester resin in which a resin component having a different structure is linked with covalent bond or ionic bond, for example, a resin in which the end of the polyester is reacted with a linkage other than an ester linkage. To be specific, a functional group such as an isocyanate group reactive with an acid group and a hydroxyl group is introduced into the end of a polyester and the end is further modified by reaction with an active hydrogen compound.

Suitable polyols (1) include diols (1-1) and polyols (1-2) having three or more hydroxyl groups. It is preferred to use a diol (1-1) alone or mixtures in which a small amount of a polyol (1-2) is mixed with a diol (1-1).

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc.

Among these compounds, alkylene glycols having from 2 to 12 carbon atoms and adducts of a bisphenol with an alkylene oxide are preferable. More preferably, adducts of a bisphenol with an alkylene oxide, or mixtures of an adduct of a bisphenol with an alkylene oxide and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (2) include dicarboxylic acids (2-1) and polycarboxylic acids (2-2) having three or more carboxyl groups. It is preferred to use a dicarboxylic acid (2-1) alone or a mixture in which a small amount of a polycarboxylic acid (2-2) is mixed with a dicarboxylic acid (2-1).

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As the polycarboxylic acid (2-2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., $\alpha, \alpha, \alpha', \alpha'$-tetramethyl xylylene diisocyanate); isocyanurates; blocked polyisocyanates in which the polyisocyanates mentioned above are blocked with phenol derivatives thereof, oximes or caprolactams; etc. These compounds can be used alone or in combination.

Suitable mixing ratio (i.e., [NCO]/[OH]) of a polyisocyanate (PIC) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner tends to deteriorate. When the [NCO]/[OH] ratio is too small, the urea content in modified polyester is low, which may lead to deterioration of anti-hot offset property. The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner tends to deteriorate and in addition this has an adverse effect on having a good combination of heat resistance and low temperature fixability of the toner. In contrast, when the content is too high, the low temperature fixability of the toner tends to deteriorate.

The average number of isocyanate groups included in the prepolymer (A) having one or more isocyanate groups per molecule is normally not less than 1, preferably from 1.5 to 3, and more preferably from 1.8 to 2.5. When the average number of isocyanate groups included therein per molecule is too small, the molecular weight of a modified polyester after cross-linking and/or elongation tends to be small, which may lead to deterioration of anti-hot offset property.

Specific examples of the amines (B) include diamines (B1), polyamines (B2) having three or more amino groups, amino alcohols (B3), amino mercaptans (B4), amino acids (B5), and blocked amines (B6), in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine and hexamethylene diamine); etc. Specific examples of the polyamines (B2) having three or more amino groups include diethylene triamine, and triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferred.

The molecular weight of the modified polyesters can be controlled using a molecular-weight control agent for cross-linking and/or elongation, if desired. Specific preferred examples of the molecular-weight control agent include monoamines (e.g., diethyl amine, dibutyl amine, butyl amine and lauryl amine), and blocked amines (i.e., ketimine compounds) prepared by blocking the monoamines mentioned above.

The mixing ratio of the amines (B) to the prepolymer (A), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1/1.2. When the mixing ratio is too large or too small, the molecular weight of the resultant urea modified polyester (i) tends to decrease, resulting in deterioration of the hot offset resistance of the resultant toner.

The urea modified polyester (i) can be prepared, for example, by a method such as one-shot methods or prepolymer methods. The weight average molecular weight of the modified polyester (i) is not less than 10,000, preferably from 20,000 to 10,000,000 and more preferably from 30,000 to 1,000,000. The peak molecular weight thereof is preferred to be from 1,000 to 10,000. When the peak molecular weight is too small, elongation reaction does not easily occur, which leads to decrease of viscosity of the resultant toner. As a result, anti-hot offset property tends to deteriorate. When the peak molecular weight is too large, the fixability may deteriorate and a problem in the manufacturing process such as granulation and pulverization may become large. When an unmodified polyester (ii) described later is used instead, the number average molecular weight of the urea modified polyester is not necessarily determined and any number which is suitable to obtain the weight average molecular weight mentioned above is allowed. When a urea modified polyester (i) is used alone, the number average molecular weight is normally not less than 20,000, preferably from 1,000 to 10,000 and more preferably from 2,000 to 8,000. When the number average molecular weight is too large, low temperature fixability of the resultant toner tends to deteriorate and in addition gloss properties thereof also tend to deteriorate when the toner is used in a full color apparatus.

In the present application, not only can the urea modified polyester (i) mentioned above alone be used as a toner binder constituent, but also the unmodified polyester (ii) can be mixed with the urea modified polyester (i) in a toner binder constituent. The combinational use of the urea modified polyester (i) and the unmodified polyester (ii) can improve low temperature fixability and gloss property when the toner is used in a full color apparatus and therefore is preferred to the single use of the urea modified polyester (i). Specific examples of the unmodified polyester (ii) include polycondensation products of polyol (1) and polycarboxylic acid (2) as mentioned in the polyester constituents of the urea modified polyester (i) mentioned above. In addition, the unmodified polyester (ii) includes not only unmodified polyesters but also polyester modified with a chemical linkage such as urethane linkage other than urea linkage. It is preferred that the urea modified polyester (i) and the unmodified polyester (ii) be at least partially compatible with each other in light of low temperature fixability and hot offset resistance. Therefore, it is preferred that the unmodified polyester (ii) should have a similar composition to that of the polyester component of the urea modified polyester (i). The ratio by weight of the urea modified polyester (i) to the unmodified polyester (ii) when the unmodified polyester (ii) is contained is normally from 5/95 to 80/20, preferably from 5/95 to 30/70, more preferably from 5/95 to 25/75 and even more preferably from 7/93 to 20/80. When the weight ratio of (i) is too small, the hot offset resistance of the toner deteriorates and in addition the toner is hard to have a good combination of the high temperature preservability and the low temperature fixability. The peak molecular weight of the unmodified polyester (ii) is normally from 1,000 to 10,000, preferably from 2,000 to 8,000 and more preferably from 2,000 to 5,000. When the peak molecular weight is too small, the high temperature preservability may deteriorate. When the peak molecular weight is too large, the low temperature fixability deteriorates. The hydroxyl group value of the unmodified polyester (ii) is preferably not less than 5 mgKOH/g, more preferably from 10 to 120 mgKOH/g and even more preferably 20 to 80 mgKOH/g. When the hydroxyl group value is too small, it is difficult for the toner to have a good combination of the high temperature preservability and the low temperature fixability. The acid value of the unmodified polyester (ii) is normally from 1 to 30 mgKOH/g, and preferably from 5 to 20 mgKOH/g. By allowing the unmodified polyester (ii) to have an acid value, the unmodified polyester resin (ii) tends to have a negative charge.

In the toner of the present application, the toner binder has a glass transition temperature (Tg) that is normally from 40 to 70° C., preferably from 55 to 65° C. When the glass transition temperature is too low, the high temperature preservability of the toner tends to deteriorate. When the glass transition temperature is too high, the low temperature fixability tend to become insufficient. In addition, the glass transition temperature of the unmodified polyester (ii) is preferably from 35 to 55° C. When an unmodified polyester resin coexists with a urea modified polyester resin, the dry toner of the present application tends to have a good high temperature preservability even when the resultant toner has a relatively low glass transition temperature in comparison with known toners formed of polyesters.

Suitable colorants for use in the toner of the present invention include known dyes and pigments. Specific examples of the colorants include carbon black, Nigrosine dyes, black iron oxide, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL RUBINE GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. The content of a colorant is from 1 to 15% by weight and preferably from 3 to 10% by weight based on a toner.

Master batch pigments, which are prepared by combining a colorant with a resin, can be used as the colorant of the toner composition of the present application. Specific examples of the resins for use in the master batch pigments or for use in combination with master batch pigments include the modified polyester resins and the unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The master batch for use in the toner of the present invention is typically prepared by mixing and kneading a resin and a colorant upon application of high shear stress thereto. In this case, an organic solvent can be used to boost the interaction of the colorant with the resin. In addition, a method referred to as a flushing method in which an aqueous paste including a colorant is mixed with a resin solution of an organic solvent to transfer the colorant to the resin solution and then the aqueous liquid and organic solvent are separated to be removed can be preferably used. In this method, drying is not necessary because the resultant wet cake of the colorant can be used as it is. In this case, three-roll mills can be preferably used for kneading the mixture upon application of high shear stress thereto.

A release agent (wax) can be included in the toner of the present invention as well as toner binders and colorants. Suitable release agents include known waxes.

Specific examples of the release agent include polyolefin waxes such as polyethylene waxes and polypropylene waxes; long chain hydrocarbons such as paraffin waxes and SAZOL waxes; waxes including a carbonyl group, etc. Among these waxes, the waxes including a carbonyl group are preferably used.

Specific examples of the waxes including a carbonyl group include polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these materials, polyalkane acid esters are preferable.

The waxes for use in the toner of the present invention preferably have a melting point of from 40 to 160° C., more preferably from 50 to 120° C., and even more preferably from 60 to 90° C. When the melting point of the wax included in the toner is too low, the high temperature preservability of the toner deteriorates. In contrast, when the melting point is too high, a cold offset problem, in that an offset phenomenon occurs at a low fixing temperature, tends to occur.

The wax used in the toner of the present invention preferably has a melt viscosity of from 5 to 1,000 cps and more preferably from 10 to 100 cps at a temperature 20° C. higher than the melting point of the wax. When the melt viscosity is too high, the effect of improving the hot offset resistance and low temperature fixability is lessened. The content of the wax in the toner is from 0 to 40% by weight and preferably from 3 to 30% by weight based on the total weight of the toner.

It is preferred to use a volatile organic solvent having a boiling point not higher than 150° C. because such an organic solvent can be easily removed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination.

In the present application, a urea modified polyester (UMPE) can be obtained by reacting a polyester prepolymer (A) having one or more isocyanate groups with an amine (B) in an aqueous medium. A method in which a toner material component containing a modified polyester such as a urea modified polyester and a prepolymer (A) is added in an aqueous medium followed by dispersion with a shearing force is used as a method of stabilizing a dispersion body formed of a modified polyester such as a urea modified polyester and a prepolymer (A). Prepolymer (A) and other toner components (hereinafter referred to as toner material) such as a colorant, a colorant agent such as master batch, a release agent and an unmodified polyester resin are dissolved or dispersed in an organic solvent and the resultant solution or dispersion is dispersed in an aqueous medium.

Suitable aqueous media for use in the toner manufacturing method of the present invention include water, and mixtures of water with a water-miscible solvent. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 to 20 μm can be easily prepared. The particle diameter (2 to 20 μm) represents a particle diameter of particles including a liquid.

When a high speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes. The temperature in the dispersion process is typically from 0 to 150° C. (under pressure), and preferably from 40 to 98° C. It is preferred that the temperature be relatively high. This is because the dispersion has a low viscosity when the temperature is relatively high so that a prepolymer (A) can be easily dispersed.

The weight ratio (T/M) of the toner components (T) including polyesters such as a urea modified polyester and prepolymer (A) to the aqueous medium (M) is typically from 100/50 to 100/2,000, and preferably from 100/100 to 100/1,000. When the ratio is too large (i.e., the quantity of the aqueous medium is small), the dispersion of the toner component in the aqueous medium is not satisfactory, and thereby the resultant toner particles may not have a desired particle diameter. In contrast, when the ratio is too small, the manufacturing costs increase.

A dispersant can be preferably used when the dispersion is prepared. When a dispersant is used, a sharp particle diameter distribution is obtained and dispersion is stabilized.

In addition, various kinds of dispersants can be used to emulsify or disperse an oil phase in which a toner component is dispersed in a liquid containing water. In the present application, a particulate dispersant such as an inorganic particulate dispersant and a polymer particulate dispersant can be used. A surface active agent can be used in combination.

Tricalcium phosphate, titanium oxide, colloidal silica, and hydroxyapatite, can also be used as an inorganic particulate dispersant hardly soluble in water.

In addition, polymer particulates can have a similar effect as an inorganic dispersant. Specific examples thereof include PB-200H (manufactured by Kao Corporation) and SGP (manufactured by Denki Kagaku Kogyo Kabushiki Kaisha), which are polymethyl methacrylate (PMMA) particulates having a particle diameter of from 1 to 3 μm, Technopolymer SB (manufactured by Sekisui Plastics Co., Ltd.) and AGP-3G (manufactured by Soken Chemical & Engineering Co., Ltd.), which are polystyrene particulates having a particle diameter of from 0.5 to 2 μm, and Micropearl (manufactured by Sekisui Chemical Co., Ltd.), which is styrene-acrylonitrile copolymer particulates having a particle diameter of 1 μm.

In addition, a polymeric protection colloid can be used as a dispersant in combination with the inorganic dispersant and the polymeric particulate mentioned above. Such a polymeric protection colloid can stabilize dispersed droplets. Specific examples thereof include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds; acid chlorides (e.g., acrylic acid chloride and methacrylic acid chloride); and monomers having a nitrogen atom or an alicyclic ring having a nitrogen atom (e.g., vinyl pyridine, vinyl pyrrolidone, vinyl imidazole and ethylene imine). Specific examples thereof include polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose.

Specific examples of such surface active agents include anionic surface active agents such as alkylbenzenesulfonic acid salts, α-olefin sulfonic acid salts, and phosphoric acid salts; cationic surface active agents such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surface active agents such as fatty acid amide derivatives, polyhydric alcohol derivatives; and ampholytic surface active agents such as alanine, dodecyldi(aminoethyl)glycin, di(octylaminoethyle) glycin, and N-alkyl-N,N-dimethylammonium betaine.

A dispersion liquid having good dispersibility can be prepared with an extremely small amount of a surface active agent having a fluoroalkyl group. Specific examples of anionic surface active agents having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium 3-{omega-fluoroalkanoyl(C6-C8)-N-ethylamino}-1-propanesulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFAC® F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can be used for dispersing an oil phase including toner components in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc.

Specific examples of the marketed products thereof include SURFLON S-121 (manufactured by Asahi Glass Co., Ltd.); FRORARD FC-135 (manufactured by Sumitomo 3M Ltd.); UNIDYNE DS-202 (manufactured by Daikin Industries, Ltd.); MEGAFAC F-150 and F-824 (manufactured by Dainippon Ink and Chemicals, Inc.); ECTOPEF-132 (from Tohchem Products Co., Ltd.); FUTARGENT F-300 (from Neos); etc.

Further, to reduce the viscosity of the dispersion medium containing a toner component, a solvent which dissolves the modified polyester (i) or the prepolymer (A) can be added. It is preferred to use such a solvent to allow the resultant toner to have a sharp particle diameter distribution. Volatile solvents having a boiling point lower than 100° C. are preferably used as the solvent because such solvents can be removed with ease after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100, and more preferably from 25 to 70 parts by weight, per 100 parts by weight of the prepolymer (A) used.

The reaction time of elongation and/or crosslinking is determined depending on the reacting property of the isocyanate structure the prepolymer (A) has and the amines (B) used, but the reaction time is generally from 10 minutes to 40 hours, and preferably 2 hours to 24 hours. The reacting temperature is generally from 0 to 150° C. and preferably from 40 to 98° C. In addition, known catalysts can optionally be used. Specific examples of the catalysts include dibutyltin laurate and dioctyltin laurate.

Amount of Remaining Solvent

The amount of solvent remaining in the toner manufactured by the present invention method is preferably not greater than 500 ppm when measured by gas chromatography. When the remaining amount is too large, the odor at fixing tends to smell strong. Further, the solvent remaining in the toner gradually moves to the surface of the toner particle during preservation. This causes a problem that the chargeability of the toner changes. The measuring method of the remaining solvent is as follows: add 2 parts by weight of 2 propanol to 1 part by weight of a target toner; subsequent to dispersion with supersonic wave for 30 minutes, preserve the dispersion in a refrigerator at 5° C. for at least one day; Extract the solvent in the toner; analyze the supernatant liquid thereof with gas chromatography GC-14A (manufactured by Shimadzu Corporation); and measure the solvent density by determining quantity of the solvent and remaining monomer in the toner.

Physical Form

It is preferred that the volume average particle diameter Dv of the toner is not greater than 10 μm to improve fine line reproducibility. On the other hand, it is preferred that the volume average particle diameter Dv of the toner is not less than 3 μm to restrain the deterioration of cleaning performance. The number of toner particles having a small particle diameter, which are not easily developed, increases at the surface of a magnetic carrier or a developing roller especially when toner particles having a particle diameter not greater than 2 μm are preset in an amount of not less than 20%. Therefore, the contact and abrasion between other toner particles and magnetic carriers or the developing roller is insufficient. This leads to the increase of reversely charged toner particles, which causes background fouling and degradation of image quality.

In addition, the particle size distribution represented by the ratio (Dv/Dn) of the volume average particle diameter Dv to the number average particle diameter Dn is preferred to be from 1.05 to 1.25. When the particle size distribution is sharp, the charge amount distribution of a toner is uniform, resulting in restraint of the occurrence of background fouling. When the ratio (Dv/Dn) is too large, the charge amount distribution tends to be wide, which may lead to difficulty in obtaining good image quality. To the contrary, when the ratio (Dv/Dn) is too small, the behavior of the toner tends to be stabilized and the amount of charge is uniform but there are problems such that the toner may not sufficiently charged and the cleaning performance may be degraded. There is no specific limit to the method and the device for use in measuring the particle diameter of a toner. For example, Coulter Counter Multisizer (manufactured by Beckman Coulter Inc.) is used to measure 50,000 particles with an aperture of 50 μm corresponding to the toner particle diameter to obtain the average particle diameter.

It is important that the toner of the present application has a specific form and a specific form distribution. When a toner has an average circularity less than 0.92, transferability may be insufficient and quality images free from dust and having a good transferability may not be obtained. There is no specific limit to the method of measuring the form. For example, an optical detection method can be used in which particle images are optically detected by a charge coupled device (CCD) camera while a suspension containing particles passes through an imaging detective portion having a plate form. The average circularity of the particle is determined by dividing the circumferential length of the circle having the area equal to a projected toner area with the circumferential length of the projected toner area. The average circularity is preferably from 0.94 to 0.96 because the average circularity has an affect on forming a fine image with a suitable density reproduction. More preferably, the average circularity is from 0.945 to 0.955 while the particle having an average circularity less than 0.94 occupies not greater than 10%. A toner having too large an average circularity may cause poor cleaning performance for an image bearing member, a transfer belt, etc., in a system adopting a blade cleaning system, which leads to fouling on an image. For example, when an image having a small image area is developed and/or transferred, the amount of toner remaining after transfer is small so that cleaning does not cause a problem. To the contrary, when an image having a large image area is developed and/or transferred or in the case of misfeeding of paper, toner not transferred may remain on an image bearing member. Such remaining toner accumulates on the image bearing member and may contaminate a resultant image. In addition, a charging roller charging an image bearing member while in contact therewith may be contaminated, resulting in deterioration of the charging ability of the charging roller. The average circularity can be measured using a flow particle image analyzer, (FPIA-2000 manufactured by Sysmex Corporation). The specific measuring method is as follows: filter water to remove solid impurity; add 0.1 to 0.5 ml of a surface active agent (preferably, alkyl benzene sulfonate) as a dispersant in 100 to 150 ml of the water in a vessel; further, add 0.1 to 0.5 g of a measured material thereto; the suspension in which the measured material is dispersed is subject to 1 to 3 minute dispersion treatment with a supersonic dispersion device such that the density of the dispersion liquid is 3,000 to 10,000 particles per μm;

and measure the form and distribution of the toner with the device mentioned above to obtain the average circularity thereof.

Additives

The toner of the present invention can contain a charge controlling agent, if desired. Any known charge controlling agent can be used. Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and therefore is not particularly limited. However, the content of the charge controlling agent is typically from 0.1 to 10 parts by weight, and preferably from 0.2 to 5 parts by weight, per 100 parts by weight of the binder resin included in the toner. When the content of a controlling agent is too high, the toner has too large of a charge quantity, and thereby the electrostatic force of a developing roller attracting the toner increases, which may lead to deterioration of the fluidity of the toner and a decrease of the image density.

An external additive can be mixed with the toner of the present application to assist in improving the fluidity, developing property, and charging ability of thereof. A suitable external additive is inorganic particulates. It is preferred for such an inorganic particulate to have a primary particle diameter of from 5 nm to 2 μm, and more preferably from 5 nm to 500 nm. In addition, it is preferred that the specific surface area of such an inorganic particulate measured by a BET method is from 20 to 500 $m^2/g$. The content of such an inorganic particulate is preferably from 0.01 to 5% by weight, and more preferably from 0.01 to 2.0% by weight, based on the total weight of the toner.

Specific examples of such inorganic particulates include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, polymer particulates such as polymers and copolymers of styrene, methacrylates, acrylates or the like; polymers prepared by polycondensation polymerization, such as silicone resins, benzoguanamine resins and nylon resins; and thermosetting resins, which can be prepared by a soap-free emulsion polymerization method, a suspension polymerization method or a dispersion polymerization method, can also be used as an external additive.

These materials for use as the external additive can be subjected to a surface treatment to improve hydrophobic property, thereby preventing the fluidity and charge properties of the toner even under high humidity conditions. Specific examples of the hydrophobizing agents include silane coupling agents, silylation agents, silane coupling agents including a fluoroalkyl group, organic titanate coupling agents, aluminum coupling agents, silicone oils, modified silicone oils, etc.

The toner of the present application can include a cleanability improving agent to improve the cleaning ability thereof such that the toner remaining on an image bearing member such as photoreceptors and intermediate transfer belts can be easily removed therefrom. Specific examples of such cleanability improving agents include fatty acids and metal salts thereof such as zinc stearate, calcium stearate and stearic acid; polymer particles which are prepared by a soap-free emulsion polymerization method or the like, such as polymethyl methacrylate particles and polystyrene particles; etc. The polymer particles preferably have a narrow particle diameter distribution and the weight average particle diameter thereof is preferably from 0.01 to 1 μm.

Developing Agent

Suitable carriers for use in the two component developer containing the toner of the present application include known carrier materials such as iron powders, ferrite powders, magnetite powders and magnetic resin carriers, which have a particle diameter of from about 20 to about 200 μm. The surface of the carriers may be coated by a resin.

Specific examples of such resins to be coated on the carriers include amino resins such as urea-formaldehyde resins, melamine resins, benzoguanamine resins, urea resins, polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present application can also be used as a single-component magnetic developer or a single-component non-magnetic developer.

Having generally described preferred embodiments of this application, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Synthesis of Unmodified Polyester

An unmodified polyester B was obtained, for example, as follows.

(1) The following components were placed in a reacting container equipped with a condenser, a stirrer and a nitrogen introducing tube and reacted for 8 hours at 230° C. under normal pressure.

| | |
|---|---|
| Adduct of bisphenol A with 2 moles of ethylene oxide | 690 |
| Terephthalic acid | 256 |

(2) The reaction was further performed for 5 hours under a reduced pressure of from 10 to 15 mmHg.

(3) Subsequent to cooling down to 160° C., 18 parts of phthalic anhydride were added thereto and the resulting mixture was allowed to react for 2 hours.

Synthesis of Prepolymer

A prepolymer (A) having an isocyanate group was obtained as follows.

(1) The following components were placed in a reacting container equipped with a condenser, a stirrer and a nitrogen introducing tube and reacted for 8 hours at 230° C. under normal pressure.

| | |
|---|---|
| Adduct of bisphenol A with 2 moles of ethylene oxide | 682 |
| Adduct of bisphenol A with 2 moles of proplyene oxide | 81 |
| Terephthalic acid | 283 |
| Trimellitic anhydride | 22 |
| Dibutyl tin oxide | 2 |

(2) The reaction was further performed for 5 hours under a reduced pressure of from 10 to 15 mmHg.

(3) Subsequent to cooling down to 160° C., 32 parts of phthalic anhydride were added thereto and the resulting mixture was allowed to react for 2 hours.

(4) Subsequent to cooling down to 80° C., 230 parts of isphorone diisocyanate were mixed with the reaction product in ethyl acetate and the resulting mixture was allowed to react for 2 hours.

Synthesis of Ketimine

Ketimine compound (1) was obtained by placing 170 parts of isophorone diamine and 75 parts of methylethyl ketone in a reacting container equipped with a stirrer and a thermometer for reaction for 5 hours at 50° C.

Manufacturing of Toner

Toner material solution (1) was prepared as follows:

55 parts of Polyester (B) and 78.6 parts of ethyl acetate were placed in a tank and stirred and dissolved; Next, 10 parts of rice wax (having a melting point of 83° C.) functioning as a release agent and 4 parts of phthalocyanine blue dye were added thereto; The mixture was stirred at 60° C. for 15 minutes using a TK HOMOMIXER at 12,000 rpm followed by dispersion at 20° C. for 60 minutes using a bead mill.

Next, 306 parts of deionized water, 265 parts of 10% suspension of tricalcium phosphoric acid and 0.2 parts of sodium dodecyl benzene sulfonate were uniformly dispersed. Thereafter, 2.7 parts of ketimine compound (1) was admixed to obtain toner material solution (2).

Emulsified primary particles were obtained by emulsifying and dispersing toner material solution (1), toner material solution (2) and prepolymer A with a ratio of 10:12:1 by an emulsification device. The piping length of the main pipe from the discharging mouth of the emulsification device to a cohesion and agglomeration controlling tank was 2 m. Thereby, the arithmetic mean accumulation time of the component therebetween was 3 times as long as that in the emulsification device. The number of the steps of the static mixer provided for the main pipe was 1 and cohesion and agglomeration was controlled under the following conditions. An emulsified dispersion liquid was thus obtained.

Conditions of Static Mixer

The static mixer used was the piping length of 400 mm per step with the number of elements of 24.

The solvent was removed as follows. The emulsified dispersion liquid obtained as described above was transferred to a tank equipped with a stirrer where the pressure can be reduced and the emulsified dispersion liquid can be heated. The diameter of the pipe to the vacuum pump provided on the upper part of the tank was 1/10 of the internal diameter of the tank. At the temperature of the liquid of 40° C. with the number of stirring rotation of 50 rpm, the pressure was reduced to a degree that foam of the emulsified dispersion liquid did not flow into the vacuum pump. The solution was removed to a density not greater than 500 ppm. Subsequent to filtration, washing and drying, mother toner particle 1 was obtained.

Example 2

Mother toner particle 2 was obtained in the same manner as in Example 1 except that, instead of the static mixer, a vortex shedder illustrated in FIG. 2 was used and rotated at 200 rpm to generate a Karman vortex street.

Example 3

Mother toner particle 3 was obtained in the same manner as in Example 1 except that, instead of the static mixer, a stirring mechanism in which a stirring bar was rotated at 200 rpm by an external magnetic field was used.

Example 4

Mother toner particle 4 was obtained in the same manner as in Example 1 except that, instead of the static mixer, an aqueous phase was used as a solvent and the cohesion and agglomeration phenomenon was controlled by dilution.

Example 5

Mother toner particle 5 was obtained in the same manner as in Example 4 except that an inline particle size distribution measuring device was provided before the treatment in which cohesion and agglomeration phenomenon was controlled by dilution and the stirring mechanism of Example 3 was provided thereafter, and the addition amount of the solvent and the number of rotation of the stirring mechanism were changed based on the amount of fine particles and coarse particles, which were the output of the measuring device.

Comparative Example 1

Mother toner particle 6 was obtained in the same manner as in Example 1 except that the static mixer was removed and the arithmetic mean accumulation time of the component between the discharging mouth of the emulsification device and the cohesion and agglomeration controlling tank was ten times as long as that in the emulsification device.

Manufacturing of Toner 100 parts of the mother toner particles obtained in each of Examples and Comparative Example were mixed with 0.7 parts of hydrophobic silica and 0.3 parts of hydrophobized titanium oxide and the mixture was mixed with a HENSCHEL mixer. The obtained characteristics of each toner are shown in Table 1.

TABLE 1

| | Controlling method | Dv μm | Dv/Dn | Content of coarse particles having a particle diameter not less than 10 μm % |
|---|---|---|---|---|
| Example 1 | Static mixer | 5.9 | 1.17 | 1.2 |
| Example 2 | Karman vortex street | 6.1 | 1.19 | 1.5 |
| Example 3 | Stirring bar | 5.8 | 1.15 | 0.5 |
| Example 4 | Dilution | 5.5 | 1.21 | 0.5 |
| Example 5 | Measuring, dilution, stirring bar | 6.0 | 1.10 | 0.3 |
| Comparative Example 1 | Conventional method | 5.8 | 1.21 | 2.0 |

A developer formed of a toner and a copper-zinc ferrite carrier with a ratio of 5 to 95 was prepared. The carrier was coated with a silicone resin and having a particle diameter of 40 μm. Using Imagio Neo 450 (manufactured by Ricoh Co., Ltd.) which can print 45 A4 sheets of paper per minute, the developer was evaluated under the following criteria. The results are shown in Table 2.

TABLE 2

| | Image quality (Fine line reproducibility) | Cleaning property | Toner odor |
|---|---|---|---|
| Example 1 | Fair | Good | Good |
| Example 2 | Good | Good | Good |
| Example 3 | Excellent | Good | Good |
| Example 4 | Good | Fair | Good |
| Example 5 | Excellent | Good | Good |
| Comparative Example 1 | Poor | Fair | Good |

Particle size distribution of toner was measured by Multi-Sizer III (manufactured by Beckman Coulter Inc.) and particles having a particle diameter not less than 10 μm was determined as coarse particles.

(b) Image Quality (Fine Line Reproducibility)

The image quality was evaluated by the fine line reproducibility. The fine line reproducibility was evaluated by observing pairs of black and white fine lines formed in 1 mm in an image chart with naked eyes while magnifying the photoreceptor with a lens after images were developed. These observed fine lines were 4.0 lines/mm, 4.5 lines/mm, 5.6 lines/mm and 6.3 lines/mm. The evaluation was determined based on how many lines were clearly separated from each other as follows:

Excellent: not less than 6.3 lines/mm
Good: 5.6 lines/mm
Fair: 4.5 lines/mm
Poor: not greater than 4.0 lines/mm (C) Cleaning Performance Cleaning performance ability was evaluated by measuring reaming toner on the photoreceptor after cleaning process with Macbeth reflection densitometer RD514. The remaining toner was transferred onto a white sheet of paper with a Scotch tape (manufactured by Sumitotmo 3M Limited). The results were evaluated as follows:

Good: not greater than 0.01
Fair: greater than 0.01 to not greater than 0.02
Bad: greater than 0.02

(d) Toner Odor 30 people evaluated the toner odor at starting of image printing and during 100,000 continuous run thereof in a sealed room having a volume of 50 $m^3$ at 20° C. and 60% RH. The evaluation items were odor strength, comfort and discomfort level, and problem level as office equipment. These items were scored and the toner odor was comprehensively ranked as follows.

Good: No practical problem as office equipment. Almost all people did not feel discomfort.
Fair: A level at which there were some people feeling discomfort.
Bad: A level at which almost all people felt discomfort and considered it a problem as office equipment.

As seen in Tables 1 and 2, cohesion and agglomeration are controlled in Examples 1 to 5 so that the production of coarse particles and deterioration of particle size distribution are restrained. In addition, the toners of Examples 1 to 5 are excellent in terms of image quality (fine line reproducibility), cleaning performance and toner odor.

This application claims priority and contains subject matter related to Japanese Patent Applications Nos. 2005-073556 and 2006-016944, filed on Mar. 15, 2005, and Jan. 25, 2006, respectively, the entire contents of which are incorporated herein by reference.

Having now fully described embodiments of the present application, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. A method of manufacturing a toner comprising:

dissolving or dispersing a toner component comprising a colorant and a resin in an organic solvent to obtain a dissolved or dispersed liquid;

continuously emulsifying and dispersing the dissolved or the dispersed liquid in an aqueous medium comprising a particulate dispersant to obtain emulsified primary particles;

controlling cohesion and agglomeration of the emulsified primary particles; and removing the organic solvent, wherein the method is performed using an emulsification device, a dispersion liquid accumulation portion, one or more piping structures having one or more controlling devices, a cohesion and agglomeration controlling tank and one or more introduction lines;

wherein the introduction lines are connected to the accumulation portion, the emulsification device is connected to the accumulation portion, and the accumulation portion is connected by the piping structures to the controlling device and then to the controlling tank;

wherein a ratio (T1/T2) of an arithmetic mean accumulation time (T1) of the emulsified primary particles in the one or more piping structures to an arithmetic mean accumulation time (T2) of the emulsified primary particles in the emulsification device and dispersion liquid accumulation portion is from 1 to 5, wherein the arithmetic mean accumulation time (T1) is calculated by dividing total volume of a portion of the one or more piping structures filled with the liquid with a total amount of liquid flowing through the one or more introduction lines and wherein the arithmetic mean accumulation time (T2) is calculated by dividing a sum of volumes of the emulsification device and dispersion liquid accumulation portion with the total amount of liquid flowing through the one or more introduction lines.

2. The method of manufacturing a toner according to claim 1, wherein the controlling is performed by a static mixer.

3. The method of manufacturing a toner according to claim 1, wherein the controlling is performed using Karman vortex street produced by a vortex shedder.

4. The method of manufacturing a toner according to claim 1, wherein the controlling is performed by a stirring bar driven by an external magnetic force.

5. The method of manufacturing a toner according to claim 1, wherein the controlling is performed by adding a liquid.

6. The method of manufacturing a toner according to claim 5, wherein the liquid comprises a surface active agent.

7. The method of manufacturing a toner according to claim 1, wherein the controlling is performed using plural pipes having a different length.

8. The method of manufacturing a toner according to claim 1, wherein the controlling is performed using plural pipes having a different diameter.

9. The method of manufacturing a toner according to claim 1, wherein the controlling is performed using a particle size distribution measuring system.

10. The method of manufacturing a toner according to claim 9, wherein the particle size distribution measuring system comprises a main pipe and a bypass pipe at which a liquid flowing in the main pipe can be sampled.

11. The method of manufacturing a toner according to claim 10, wherein the particle size distribution measuring system further comprises a mechanism of controlling an accumulation time of the liquid flowing in the bypass pipe.

12. The method of manufacturing a toner according to claim 10, wherein the particle size distribution measuring system further comprises a valve by which sampling a liquid from the bypass pipe can be intermittently performed.

13. The method of manufacturing a toner according to claim 12, wherein the particle size distribution measuring system further comprises a device configured to dilute the sample liquid obtained using the valve and a mechanism configured to set a dilution ratio of the sample liquid.

14. The method of manufacturing a toner according to claim 13, wherein the dilution ratio is from 300 to 2,000.

15. The method of manufacturing a toner according to claim 10, wherein the particle size distribution measuring system comprises a device configured to return the liquid complete with the particle size distribution measurement to the main pipe.

* * * * *